US010112064B2

(12) United States Patent
Bouquier

(10) Patent No.: US 10,112,064 B2
(45) Date of Patent: Oct. 30, 2018

(54) HARNESS

(71) Applicant: ZEDEL, Crolles (FR)

(72) Inventor: Benoît Bouquier, Corenc (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/458,613

(22) Filed: Mar. 14, 2017

(65) Prior Publication Data

US 2017/0291047 A1 Oct. 12, 2017

(30) Foreign Application Priority Data

Apr. 8, 2016 (FR) ..... 16 53153

(51) Int. Cl.
*A62B 35/00* (2006.01)

(52) U.S. Cl.
CPC ..... *A62B 35/0037* (2013.01); *A62B 35/0006* (2013.01); *A62B 35/0012* (2013.01); *A62B 35/0018* (2013.01); *A62B 35/0025* (2013.01); *A62B 35/0031* (2013.01)

(58) Field of Classification Search
CPC ..... A62B 35/0037; A62B 35/0018
See application file for complete search history.

(56) References Cited

U.S. PATENT DOCUMENTS 3,757,893 A * 9/1973 Hobbs ..... A62B 35/0025 182/6
4,553,633 A * 11/1985 Armstrong ..... A62B 35/0037 119/857
8,967,332 B2 * 3/2015 Wolner ..... A62B 35/0031 182/3
2013/0104374 A1 * 5/2013 Schlangen ..... F16B 45/02 29/525.01

(Continued)

FOREIGN PATENT DOCUMENTS

DE 202012012390 U1 * 8/2013 ..... A62B 35/0037
FR 2 945 221 A1 11/2010

(Continued)

OTHER PUBLICATIONS

Anonymous: "X-320 2-Stage Seat/Full Body Convertible Harness System," Jul. 13, 2014, XP055321411, Retrieved from: https://web.archive.org/web/20140713072418/fttp://shop.deusrescue.com/Shop-Products/X-320-2-Stage-Seat-Full-Body-Convertible-Harness-System.html?, Retrieved Nov. 21, 2016.

(Continued)

*Primary Examiner* — Katherine W Mitchell
*Assistant Examiner* — Candace L Bradford
(74) *Attorney, Agent, or Firm* — Oliff PLC

(57) ABSTRACT

The invention relates to a harness comprising a belt and a pair of thigh straps and a ventral suspension point. The ventral suspension point comprises:

a connector positioned on the belt, the connector comprising a connecting ring fitted movable in rotation with respect to the belt by means of a rod of longitudinal axis, the rod comprising a first end and a second end opposite the first end along the axis of rotation of the connecting ring, a first attachment part and a second attachment part designed to be connected to an external device, the first attachment part and the second attachment part being placed on the connector along the axis of rotation of the connecting ring and outside the connecting ring.

20 Claims, 8 Drawing Sheets

(56) References Cited

U.S. PATENT DOCUMENTS

| | | | | |
|---|---|---|---|---|
| 2014/0224580 | A1* | 8/2014 | Casebolt | A62B 35/0025 182/3 |
| 2014/0262608 | A1 | 9/2014 | Patel et al. | |
| 2014/0325733 | A1 | 11/2014 | Rae et al. | |
| 2016/0361577 | A1* | 12/2016 | Perner | A62B 35/0037 |
| 2017/0216635 | A1* | 8/2017 | Stibilj | A62B 35/0018 |

FOREIGN PATENT DOCUMENTS

| | | | | |
|---|---|---|---|---|
| FR | 3041264 | A1 * | 3/2017 | A62B 35/0037 |
| FR | 3041264 | A1 * | 3/2017 | A62B 35/0037 |
| GB | 190600272 | A | 10/1906 | |
| GB | 190715382 | A | 3/1908 | |
| WO | 2010/097824 | A1 | 9/2010 | |
| WO | 2011/127109 | A2 | 10/2011 | |
| WO | 2013/063384 | A2 | 5/2013 | |

OTHER PUBLICATIONS

Anonymous: "COBRA", Cobra Buckles, Mar. 27, 2014, p. 4, XPO55321220, www.austrialpin.at, Retrieved from: https://web.archive.org/web/20140327110656/http://downloards.austrialpin.at/cobra.pdf, Retrieved Nov. 21, 2016. * p. 4 *, 22 pages.

U.S. Appl. No. 15/458,468, filed Mar. 14, 2017 in the name of Benoît Bouquier.

* cited by examiner

HARNESS

BACKGROUND OF THE INVENTION

The invention relates to a harness comprising a connector configured to enable attachment of an external element.

STATE OF THE ART

In the scope of a professional activity, a rope access technician or 'acrobatic worker' may be suspended in the same place for a long time. The latter is therefore sitting in his harness, his thighs being held by means of the thigh straps.

This position may prove uncomfortable when the person remains in the same position for a long time. The worker can therefore use a chair in order to have an additional seating surface, which limits the pressure exerted by the thigh straps on the thighs.

The chair comprises a large seat of substantially rectangular shape terminated at each end by a strap. The latter can be connected to a harness by means of two connectors such as karabiners or quick links.

In order not to hamper the user in these different actions, the chair has to be removable and above all it has to be movable in order not to prevent the user from working efficiently on his legs when this is necessary. Depending on the harness models, the chair can be attached in different manners. It can for example be attached to a connecting ring or to the belt of the harness.

For a harness 1 such as the one disclosed in International Patent application WO 2010/097824 A1 and illustrated in FIG. 1, the chair can be attached to a connecting ring 2 fixed on the belt 3. The connecting ring can move in rotation with respect to the belt 3, in the direction of a horizontal axis when the harness 1 is worn by a user. According to the embodiment disclosed in this document, the chair is attached to the connecting ring by means of two connectors. This configuration seems to procure a good user comfort in the seated position. But it does however present several shortcomings.

The first shortcoming is that the connecting ring 2 serves the purpose of attaching several external elements to the harness 1: the chair, one or more karabiners, but also one or more accessories for progression on the rope. The connecting ring 2 is therefore finally cluttered up with a large number of parts. Fittingly connecting parts in a single place can however give rise to safety problems if the rope access technician inadvertently releases one of his accessories which he wanted to keep attached.

Furthermore, when the user is suspended in his harness 1, the descender or the clamp exert a force making the connecting ring 2 move upwards. On the other hand, the connectors enabling the chair be attached exert a force making the connecting ring 2 pivot downwards. The resultant of these opposing forces has the effect of making the connecting ring 2 swivel downwards, which may represent a hamper for the rope access technician for example on account of a non-optimal operation of the clamp or of the descender. It is therefore not practical to keep the chair attached to the connecting ring 2 when the user is no longer suspended on the rope.

It also happens that when the user is sitting in his chair, the connecting ring 2 is directed downwards and it may be difficult to manipulate it to add an accessory to it for progression on the rope.

With this type of attachment, the tension exerted on the chair varies according to the tension exerted on the clamp, so that the quality of the seating may be impaired in the course of time.

Certain harnesses 4 such as the one marketed by the applicant under the trade name Avao® tend to prevent the discomfort caused by an incorrect position of the connecting ring 5 and by the multiplication of the connectors attached to the connecting ring 5. The harness 4 comprises two strap rings 6 positioned on the ventral part of the belt 7 and enabling an external element to be connected to the harness 4. The connecting ring 5 then only serves the purpose of attaching a lanyard, a clamp or a descender. When the worker is suspended on the rope, the position of the connecting ring 5 is optimal in an upwards direction. If the worker on the rope is not suspended, the connecting ring 5 can easily swivel around its axis of rotation, and it is easy to reconnect a descender or a clamp if necessary.

The strap rings 6 of the harness are sewn vertically (when a user is wearing the harness) on the belt 7. It is nevertheless apparent that the user comfort is not as efficient as in the previous configuration.

Furthermore the strap rings 6 do not work in an optimal orientation. The forces exerted by the chair connectors on the strap rings 6 are not vertical whereas the seams of the strap rings 6 on the belt 7 of the harness 4 are. This can give rise to premature wear of the harness 4 able to lead to more frequent repairs.

OBJECT OF THE INVENTION

One object of the invention consists in remedying these shortcomings and in providing a harness to which the chair can be attached in order to guarantee a maximum of user comfort, and for which connection of a chair does not give rise to any safety or discomfort problems when the user is suspended in his harness.

For this purpose, the harness can comprise a belt and a pair of thigh straps. It further comprises:

- a connector positioned on the belt and comprising a connecting ring mounted movable in rotation with respect to the belt, on a rod of longitudinal axis AA comprising a first end and a second end opposite the first end,
- a first attachment part and a second attachment part designed to be connected to an external device, the first attachment part and the second attachment part being placed on the connector in the direction of the longitudinal axis AA and outside the connecting ring.

According to one feature of the invention, the first attachment part can be fitted mobile in rotation on the rod. The latter can furthermore be wider than the connecting ring, and the first attachment part can be arranged at the first end of the rod.

The first end of the rod can comprise a first groove, and the first attachment part can comprise a first opening configured to collaborate with the first groove so as to be movable in rotation along the longitudinal axis AA, In alternative manner, the first end of the rod comprises a first hook, and the first attachment part can be configured to collaborate with the first hook so as to be movable in rotation along the longitudinal axis AA and along an axis orthogonal to the axis AA.

In this case, the first hook can collaborate with the first attachment part so as to define a first angular position enabling the first attachment part to be inserted and extracted, and to disable extraction of the first attachment part when the angular position is different from the first angular position.

The first attachment part can also be a first hole passing through the axis orthogonal to the longitudinal axis AA.

The second attachment part can advantageously have a symmetrical position with respect to the first attachment part in a plane orthogonal to the longitudinal axis AA. It can also be fitted movable in rotation on the rod.

According to one embodiment, the rod can be wider than the connecting ring, and the second attachment part can be arranged on the second end of the rod.

The second end of the rod can further comprise a second groove, and the second attachment part can comprise a second opening configured to collaborate with the groove so as to be movable in rotation along the longitudinal axis AA.

According to an alternative embodiment, the second end of the rod can comprise a second hook, and the second attachment part can be configured to collaborate with the second hook so as to be movable in rotation along the longitudinal axis AA and along an axis orthogonal to the axis AA.

Alternatively, the second attachment part can be a second hole passing through the axis orthogonal to the longitudinal axis AA.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
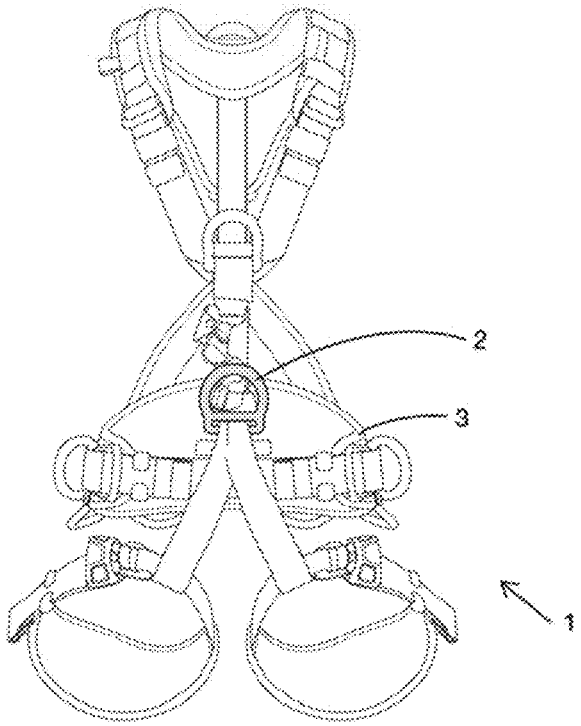
FIG. 1 Related Art
FIGS. 1 and 2 illustrate two alternative embodiments of the harness according to the prior art in schematic manner.
Figure 2:
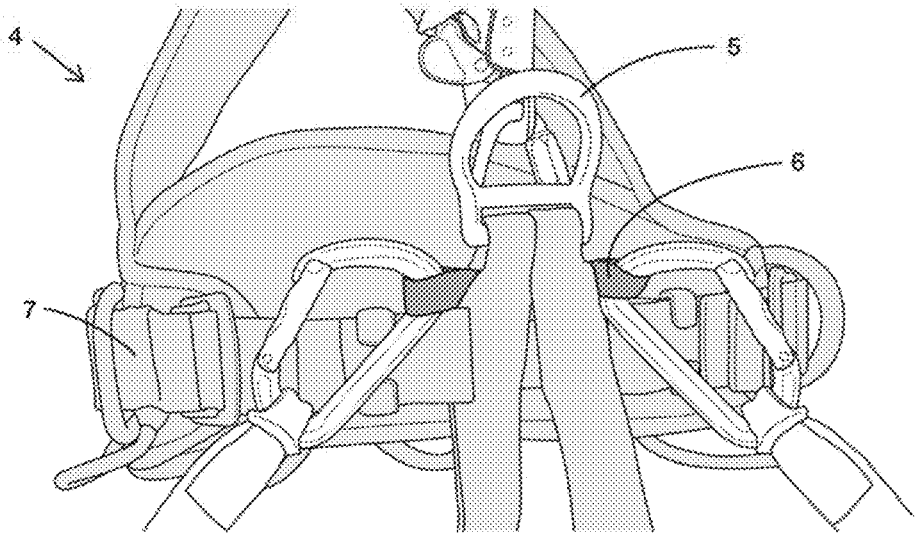
FIG. 2 Related Art

As in the prior art, a harness 10 according to the invention comprises a belt 11 and a pair of thigh straps 12, and is designed to be associated with a pair of chest straps 13 fitted in removable or unremovable manner on the belt 11, The harness comprises a ventral suspension point which is configured to make the mechanical connection between an attachment point and the belt of the harness when the user is suspended in the harness, The ventral suspension point 10 comprises a connector 14 positioned on the belt 11, preferably on the ventral part of the belt 11. The connector 14 is securedly attached to the belt 11 Depending on the embodiments, the connector 14 can be fitted in removable manner or not on the belt 11.

The connector 14 comprises a connecting ring 15 fitted movable in rotation with respect to the belt 11. The connecting ring 15 is configured to enable fixing of one or more tools and/or of one or more connecting parts.

What is meant by tool is for example a lanyard with or without an absorber, a mobile anti-fall device, a cam-based descender, or a rope clamp. What is meant by connecting part is for example a strap, a karabiner, a quick link, a shackle and/or a swivel attachment.

For example purposes, an accessory for progression on a rope such as a descender or a clamp can be attached to the connecting ring 15 of the connector 14 to support the user in the course of his professional activity.

Several embodiments of the connector 14 can be envisaged. The connecting ring 15 can be of any shape which does not constitute a closed contour, and the rod 16 can close the contour. In this case, this enables an accessory for progression on a rope to be fixed in the connecting ring 15 without the need for using an intermediate connecting part. As an alternative, the connecting ring 15 can on its own define a closed contour. The rod 16 is then spaced apart from the connecting ring 15.

The rod 16 can be monoblock with the rest of the connector. This makes the connector 14 easier to achieve and the risks of handling errors are reduced.

The rod 16 and connecting ring 15 can also be movable with respect to one another. In particular the connecting ring 15 can be movable in rotation around the rod 16 of longitudinal axis AA. As a variant, the connecting ring 15 can be fixed to the rod 16 and the assembly can be movable in rotation with respect to the belt 11.

The rod 16 act as securing means of the connector 14 on the belt 11. The rod can for example collaborate with a strap forming a loop, the rod 16 passing inside the loop to attach the connector 14 to the belt 11.

In a particular embodiment, the rod 16 is placed at a distance from the connecting ring 15 and a strap passes between the rod 16 and connecting ring 15. The strap advantageously connects the belt 11 to the pair of thigh straps 12 and forms a loop around the rod 16.

In an advantageous implementation, the connecting ring 15 is a closed contour which is placed at a distance from the rod 16 and dissociated from the latter. In this case, the connecting parts, for example karabiners, attached to the connecting ring 15, cannot generate premature wear of the strap situated between the connecting ring 15 and rod 16 or of any other securing means with the belt 11.

The harness 10 further comprises a first attachment part 17 which enables an external device such as a seat to be attached with the harness 10. The first attachment part 17 is placed on the connector outside the connecting ring 15.

The first attachment part 17 can be produced in different manners, for example by means of an aperture passing through the connector 14, a hook salient from the connector 14, a pin protruding out from the connector 14 or from a hole. This first attachment part 17 collaborates with the external device to be attached to the harness 10.

According to an advantageous embodiment, the harness 10 can comprise a second attachment part 18 in order to connect thereto an external device such as a chair 19. The first and second attachment parts 17 and 18 enable the chair to be attached and prevent the connecting ring 15 from being cluttered up. What is proposed for the first attachment part 17 can also be performed on the second attachment part 18.

If the first and second attachment parts 17 and 18 are both used for attaching the same chair 19, the forces exerted by the chair 19 on the harness 10 are better distributed. This enables an enhanced comfort of the harness 10 to be ensured.

Figure 3:
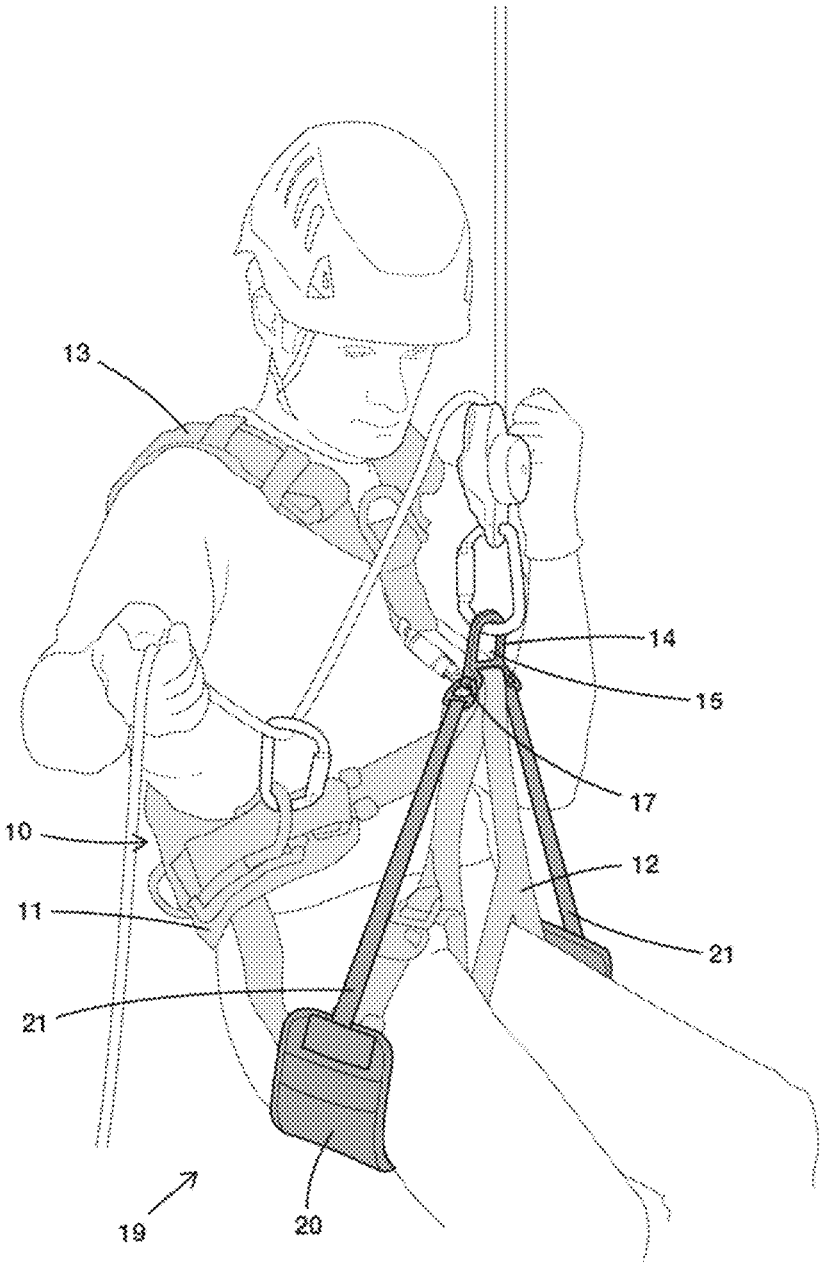
FIG. 3 is a general view of an embodiment of the harness on which a chair is fitted.

According to the embodiment illustrated in FIG. 3, the chair 19 comprises a seat 20 connected to the harness 10 by means of two flexible connections 21 22. Each flexible connection is fixed on one side to the seat 20 and on the other side to the connector 14. The flexible connections 21 and 22 can for example be straps. Depending on the embodiments, the flexible connections 21 and 22 can be fixed directly in the first and second attachment parts 17 and 18, or an intermediate fixing means can be used in order to facilitate connection between the flexible connections 21 and 22 and the first and second attachment parts 17 and 18 and/or to prevent premature wear of the flexible connections 21 and 22.

This configuration is particularly advantageous to facilitate use of the connector 14 fitted on the harness 10. Dissociating the connecting ring 15 from the first and/or second attachment parts 17 and 18 does in fact enable the connecting ring 15 to be decluttered, thereby increasing user safety when he is handling the different connection parts installed in the connector 14.

The inventors discovered that placing at least one attachment part on the connector 14 enables an optimal user comfort to be preserved when the chair 19 is attached to the harness 10. Indeed, fixing at least one attachment part on the connector 14 enables the latter to be placed substantially at the same level as the connecting ring 15, and therefore substantially at the same level as the suspension point of the user on a rope.

In comparison with the embodiment of the prior art where the attachment parts are made on the belt, the seat of the chair is more comfortable. A good offloading of the pair of thigh straps 12 to the chair 19 is obtained, which enhances user comfort when the latter is suspended.

Furthermore, the movement of the first and/or second attachment parts 17 and 18 is linked to that of the connecting ring 15, which facilitates use of the connecting ring 15 under varying conditions.

An embodiment of the harness 10 comprising a single attachment part can be functional, as can be an embodiment of the harness 10 comprising two attachment parts arranged in non-symmetrical manner on the connector 14.

The inventors also observed that placing the first attachment part 17 along the axis AA of rotation of the connector 14 is preferable. Indeed, when the connector is used, the latter may be called on to rotate around the axis AA depending on the operations performed by the user. Placing the first attachment part 17 and/or second attachment part 18 on the axis AA enables the torque forces applied on the connector 14 to be considerably reduced, which facilitates handling of the connecting ring 15 to attach a fixing part thereto and/or to adjust the chair 19.

In order to increase user comfort of the harness 10, the inventors also observed that it is advantageous to provide for the first attachment part 17 and/or second attachment part 18 to be configured to allow rotation of the chair 19 with respect to the connecting ring 15 in a direction which is parallel or substantially parallel to the axis AA of the rod 16.

This rotation of the chair 19 with respect to the connecting ring 15 facilitates use of the latter as seating surface and stowing of the latter behind the user's back for example when the latter takes his weight on his legs.

Enabling rotation of the chair 19 around an axis parallel to the axis AA enables the forces applied on the connecting ring 15 and on the parts constituting the chair 19 to be reduced. Depending on the operations to be performed, the user does in fact move the chair 19 by rotation between a seated position and a stowed position. Although fixing of the chair 19 to the connector 14 is performed by means of a flexible connection such as a strap, it is more comfortable for the strap to rotate instead of deforming to swivel between the seated and stowed positions.

This rotation also enables movement of the connecting ring 15 to be reduced when the user moves from a seated position to a stowed position of the chair 19. This rotation also facilitates handling of the connecting ring 15 to add a tool to it when the first attachment part 17 and/or second attachment part 18 exert a force on the connector 14.

In advantageous manner, the first attachment part 17 is arranged along the AA and enables rotation of the chair 19 around the axis AA. Like the first attachment part 17, the second attachment part 18 can advantageously be placed on the axis AA of rotation of the connector 14. In this configuration, if a chair 19 is attached to the first and second attachment parts 17 and 18 at the level of the longitudinal axis AA, the weight of the chair 19 does not hamper movement of the connector 14 which remains free to swivel around the axis AA.

Different embodiments can be envisaged to achieve the harness 10, so as to ensure an enhanced user comfort.

Figure 4:
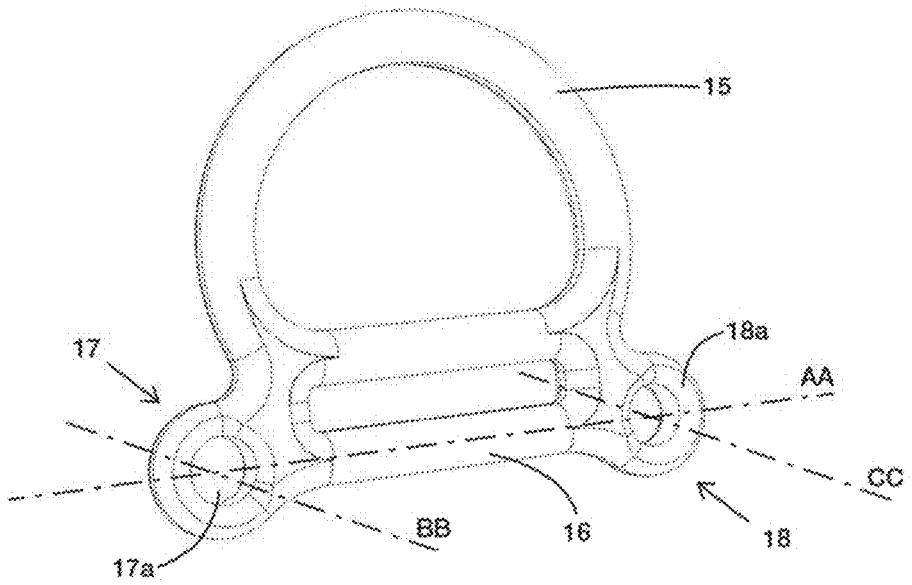
FIGS. 4 to 6 illustrate three alternative embodiments of the connector fitted on the harness according to the invention.

According to a first embodiment of the connector 14 illustrated in FIG. 4, the first attachment part 17 can comprise a first pass-through hole 17*a* able to be of any shape.

In advantageous manner, the pass-through hole 17*a* advantageously forms a closed contour which presents an axis of rotation BB orthogonal to the axis AA. In a particular embodiment, the hole is centred on the axis AA of the rod 16. However it can also be envisaged to provide for the hole 17*a* to be slightly offset with respect to the axis AA without this changing the user's sensations. What is meant by slightly offset with respect to the axis AA is that the hole 17*a* is located at least 15 mm from the axis AA.

In advantageous manner, the connector 14 presents a plane of symmetry in the thickness direction. It is then particularly advantageous to provide for the axis BB to be perpendicular to this plane of symmetry.

The first attachment part 17 is advantageously positioned at a first end of the rod 16 in order not to hamper movement of the strap surrounding the rod 16. The same is the case for the second attachment part 18 positioned at the other end.

The pass-through hole 17*a* can collaborate with a closed connecting part (not shown) as described above, for example a karabiner or a quick link. As a variant, it is also possible to provide an open connecting part, for example a hook or any other curved part.

In this embodiment, the pass-through hole 17*a* is configured to allow movement and rotation of the connecting part inside the pass-through hole 17*a*. The connecting part is therefore movable in rotation and in translation inside the pass-through hole 17*a*. To guarantee the mobility of the connecting part, its cross-section preferably has a surface comprised between 50 and 80% of the surface of the first pass-through hole 17*a*.

In this embodiment, the harness 10 comprises a second attachment part 18 similar to the first attachment part 17. This involves a pass-through hole 18*a* of axis CC orthogonal to the axis AA. The axis CC can be parallel to the axis BB as in the embodiment illustrated in FIG. 4. But it can also not be parallel while at the same time keeping a functional harness 10.

The second attachment part 18 can be located at a second end of the rod 16 opposite the first end. The first and second attachment parts 17 and 18 can have the same shape and ideally have the same dimensions. The pass-through holes

17*a* and 18*a* can for example have a diameter comprised between 10 and 15 mm and preferably equal to 12 mm.

The connecting parts serving the purpose of connecting the external device to the attachment parts 17 and 18 can also have the same shape, and ideally have the same dimensions. The second pass-through hole 18*a* can in particular collaborate with a connecting part having a cross-section which preferably has a surface comprised between 50 and 80% of the surface of the second pass-through hole 18*a*.

In order to improve user comfort by balancing the loads on the harness 10, it may be advantageous to position the first and second attachment parts 17 and 18 at the same distance from the axis 16 so that rotation of the connecting ring 15 has the same result on each side of the chair.

In even more advantageous manner, the first and second attachment parts 17 and 18 can be placed on the connector in symmetrical manner in a plane orthogonal to the axis AA and passing through the middle of the rod 16. If the connector 14 is considered to be placed in the centre of the ventral part of the harness 10, this results in the weight of an external device on the first and second attachment parts 17 and 18 being distributed in balanced manner between the left and right of the harness 10.

In the embodiment illustrated in FIG. 4, the rod 16 of the connector 14 can be movable in rotation with respect to the assembly formed by the connecting ring 15, first attachment part 17 and second attachment part 18.

This feature presents the advantage of limiting friction on the strap surrounding the rod 16.

It is however quite possible to produce a harness 10 in which the connector 14 and first and second attachment parts 17 and 18 are manufactured in a single step. This configuration is functional and presents the advantage of being simpler to manufacture.

Figure 5:
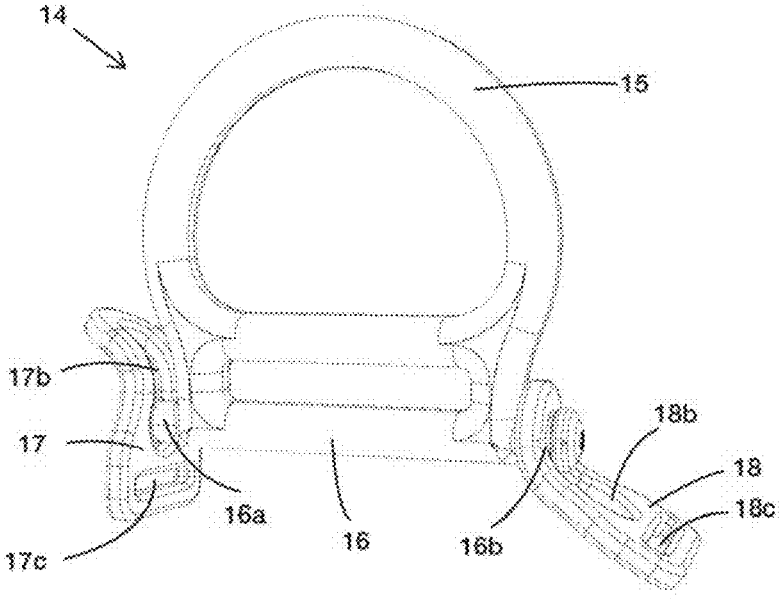
Figure 6:
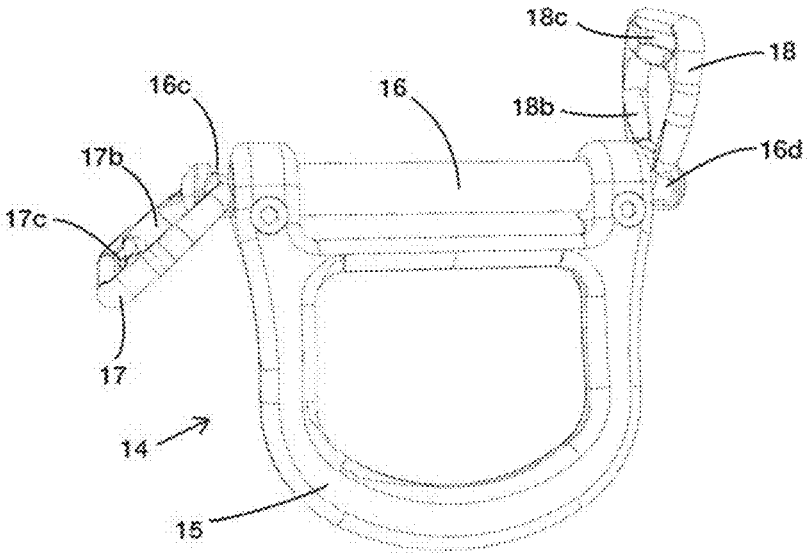

According to alternative embodiments of the connector 14 insulated in FIGS. 5 and 6, the rod 16 can be wider than the connecting ring 15, and the connecting ring 15 can be fitted movable in rotation on the rod 16.

As stipulated in the foregoing, the fact that the connecting ring 15 is movable in rotation with respect to the rod 16 limits the friction of the connector 14 on the connecting strap between the belt 11 and the pair of thigh straps 12. The connector 14 is therefore more mobile and can therefore more easily follow the movements of an ascending progression on the rope.

Moreover, the fact that the rod 16 is wider than the connecting ring 15 enables the first attachment part 17 to be positioned at a first end of the rod 16, and makes it possible if required to position a second attachment part 18 at a second end opposite the first end.

As illustrated in FIG. 5, the rod 16 can comprise a first groove 16*a* situated at the first end. The first attachment part 17 can for example be a plate comprising a first aperture 17*b* having a wide side and narrow side, the wide side advantageously being larger than the width of the rod 16, and the narrow side advantageously being smaller than the width of the rod 16. The first attachment part 17 can also comprise a first slot 17*c* that is sufficiently large for a connecting strap with the external device to pass through it.

The first groove 16*a* can be positioned inside the first opening 17*b* by inserting the first end of the rod 16 through the widest part of the first opening 17*b*, and in then moving the first attachment part 17 until the first end of the rod 16 is positioned on the side where the first opening 17*b* is narrow.

After the first attachment part 17 has been positioned in the groove 16*a* of the rod 16, the first attachment part 17 is movable in rotation with respect to the rod 16, i.e. with respect to the axis AA. Due to the effect of the weight of the external device connected by means of the attachment part 17, the first end of the rod 16 is kept in the opening 17*b* on the narrower side. On account of the fact that the rod 16 is wider than the narrow side of the first opening 17*b*, the rod 16 and the attachment part 17 remain secured to one another, the first attachment part 17 being able to swivel with respect to the rod 16. An external device such as a chair 19 can therefore follow the movements of a user, and the connector 14 can move in order to follow the movements of an accessory for progression on the rope. The movements of the connector 14 on the one hand and of the first attachment part 17 on the other hand are completely decorrelated.

The harness 10 can also comprise a second attachment part 18 similar to the attachment part 17 which has just been described. The latter can comprise a second opening 18*b* having an end that is wider than the width of the rod and an end that is narrower than the width of the rod. The attachment part 18 can also comprise a second slot 18*c* allowing passage of a strap serving the purpose of connecting an external device.

The second opening 18*b* of the second attachment part 18 can advantageously collaborate with a second groove 16*b* situated at a second end of the rod 16. As for the first attachment part 17, the second attachment part 18 can pivot with respect to the rod 16. In this way, the movements of the connector 14 and of the second attachment part 18 are decorrelated when an external device is connected to the harness 10 by means of the second attachment part 18.

The embodiment illustrated in FIG. 5 comprises identical first and second attachment parts 17 and 18, but an embodiment in which the first attachment part 17 is a pass-through hole such as the one represented in FIG. 3, and in which the second attachment part 18 is a plate such as the one represented in FIG. 4 can quite easily be imagined.

It is also possible to manufacture a connector 14 comprising a rod 16 that is fixed with respect to the connecting ring 16 and is provided with two grooves at each of its ends. In an embodiment of this type, the friction forces between the connector 14 and the first and second attachment parts 17 and 18 are increased compared with an embodiment where the rod 16 is movable with respect to the connecting ring 15. The friction forces are sufficiently low not to hamper use of the harness 10.

The alternative embodiment represented in FIG. 6 provides for a first hook 16*c* situated at a first end of the rod 16. The first hook 16 is configured to collaborate with a first attachment part 17 such as a plate. It comprises a first opening 17*b* in which the hook 16*c* can be inserted, and a first slot enabling a connecting strap with an external device to pass through.

Figure 7:
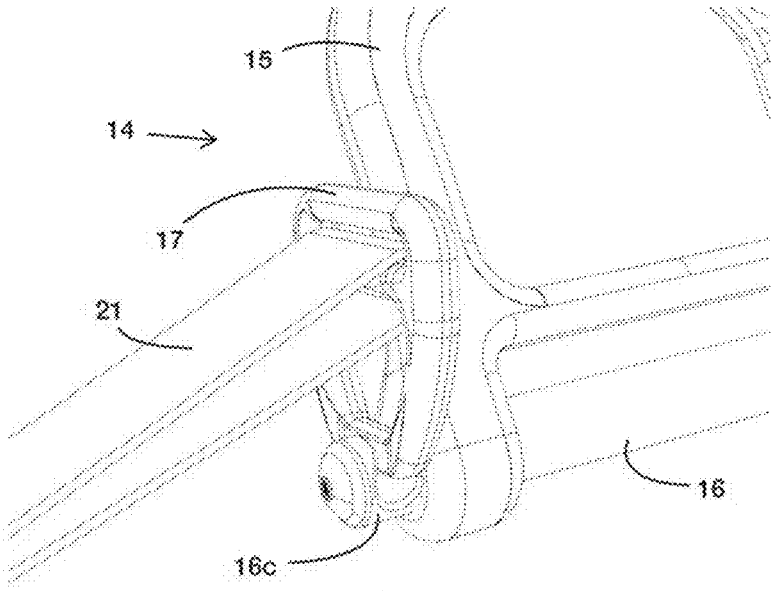
FIGS. 7 and 8 present the manner in which an external device can be assembled to the connector according to the embodiment of FIG. 6, FIG. 9 schematically represents a harness comprising an additional alternative embodiment of the connector.

According to a particularity of this embodiment, the edges of the first attachment part 17 are thinned or advantageously have a cross-section of oblong or ellipsoid shape so as to have a small width and a large width. The first hook 16*c* advantageously has an opening that is wider than the small width but smaller than the large width. In this way, the first attachment part 17 can only be inserted in the first hook 16*c* when it is placed in a particular position, for example the position illustrated in FIG. 7.

In more general manner, the first attachment part 17 and first hook 16*c* are configured to allow rotation of the first attachment part 17 inside the first hook 16*c*. The first hook 16*c* defines an opening distance which corresponds to the distance at the surface of the rod 16 separating two opposite edges of the hole from the first hook 16*c*. The depthwise dimension of the hole is larger than the opening distance so as to allow rotation of the first attachment part 17 in the first hook 16*c* and to prevent extraction of the first hook 16*c* in certain configurations.

The first attachment part 17 has two different thicknesses in the same cutting plane. A first thickness is configured to enable insertion and extraction of a first attachment part 17 in and out of the first hook 16*c*. A second thickness is configured to prevent extraction of the first attachment part 17 from the first hook 16*c*.

In advantageous manner, the first thickness is smaller than or equal to the opening distance so as to allow insertion and extraction of the first attachment part 17. The second thickness is larger than the opening distance so as to prevent extraction. This configuration enables a precise angular position to be imposed to enable insertion and extraction of the first attachment part 17 in the first hook 16*c* and to prevent this extraction in the other angular positions.

Figure 8:
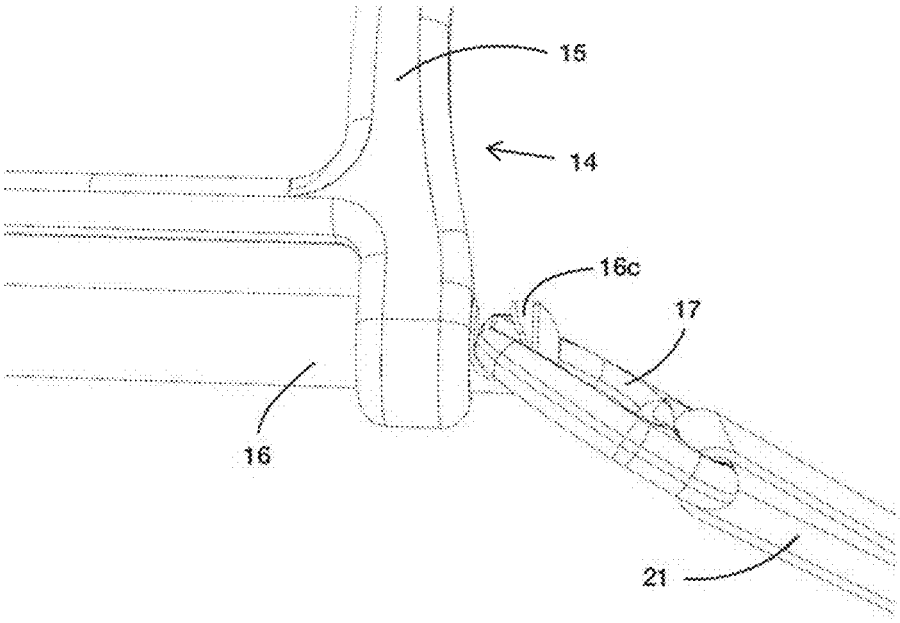

This specificity prevents nuisance disconnection of the first attachment part 17 and of the rod 16. Indeed, when the attachment part 17 is connected to an external device, the weight of the external device has the effect of keeping the attachment part 17 in a position where it cannot be removed from the hook 16*c*. This configuration is illustrated in FIG. 8.

In the embodiment illustrated in FIG. 6, the first attachment part 17 has two degrees of freedom with respect to the rod 16: it is movable in rotation with respect to the axis AA and with respect to an axis orthogonal to the plane of symmetry of the connector 14. Using a first hook 16*c* to connect the first attachment part 17 gives the first attachment part 17 an additional degree of freedom, in comparison with the embodiment illustrated in FIG. 4.

By means of this type of connection, the external device can even more easily follow the user's movements without hindering the movements of the connector 14.

Furthermore, a second hook 16*d* situated at the second end of the rod 16 can be used in association with a second attachment part 18 comprising similar properties to those of the first attachment part 17 as has just been described.

The second attachment part 18 can thus comprise a second opening 18b collaborating with the second hook 16*d* in order to make a connection between the harness 10 and an external part. The external part is for its part connected to the second attachment part 18 by means of a strap passing through a second slot 18*c* of the second attachment part 18.

FIG. 6 illustrates an embodiment in which the rod 16 comprises a hook at each of its ends, and in which the first and second attachment parts 17 and 18 are identical. It can however be envisaged to provide a connector 14 in which the rod 16 comprises a groove at a first end and a hook at a second end.

Figure 9:
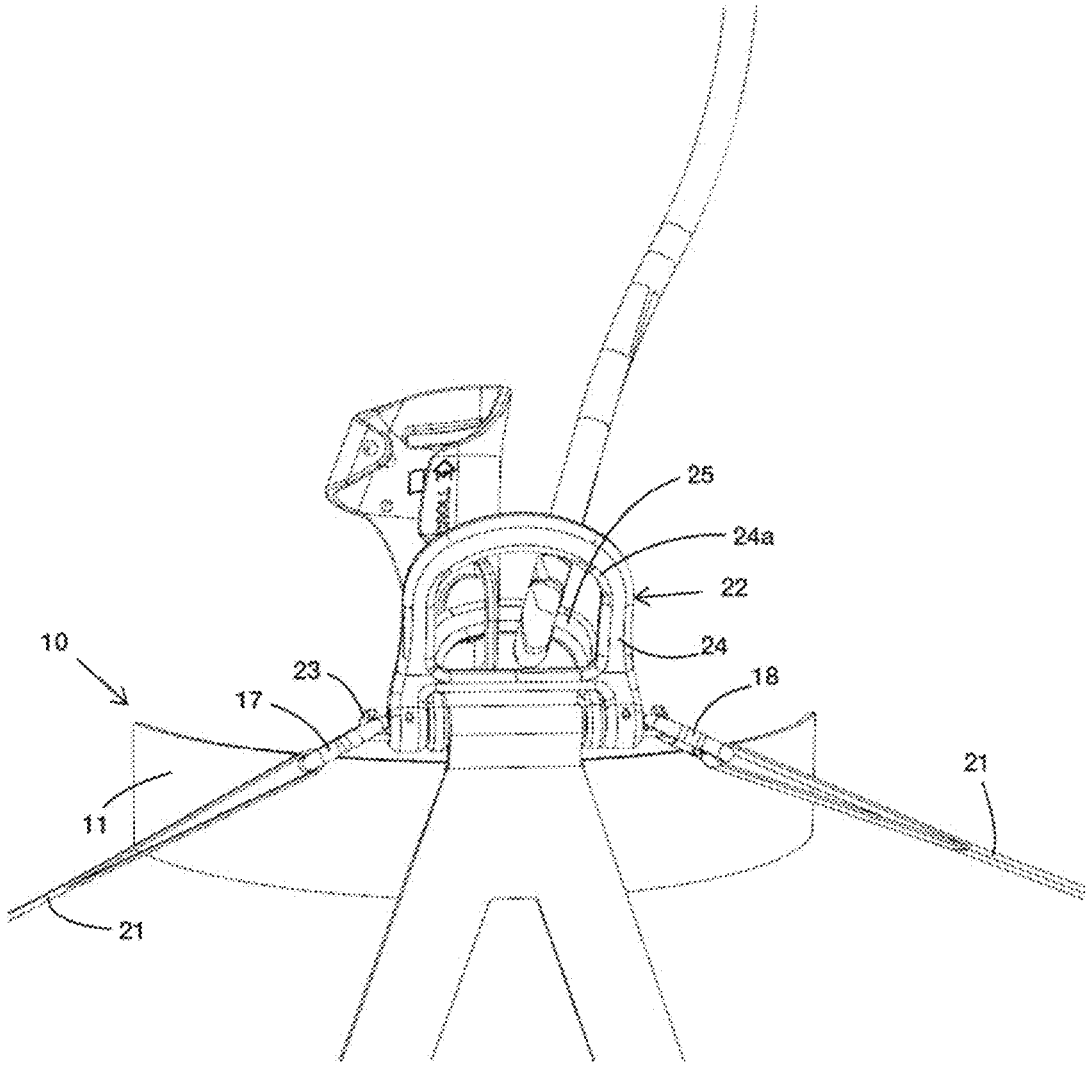
Figure 10:
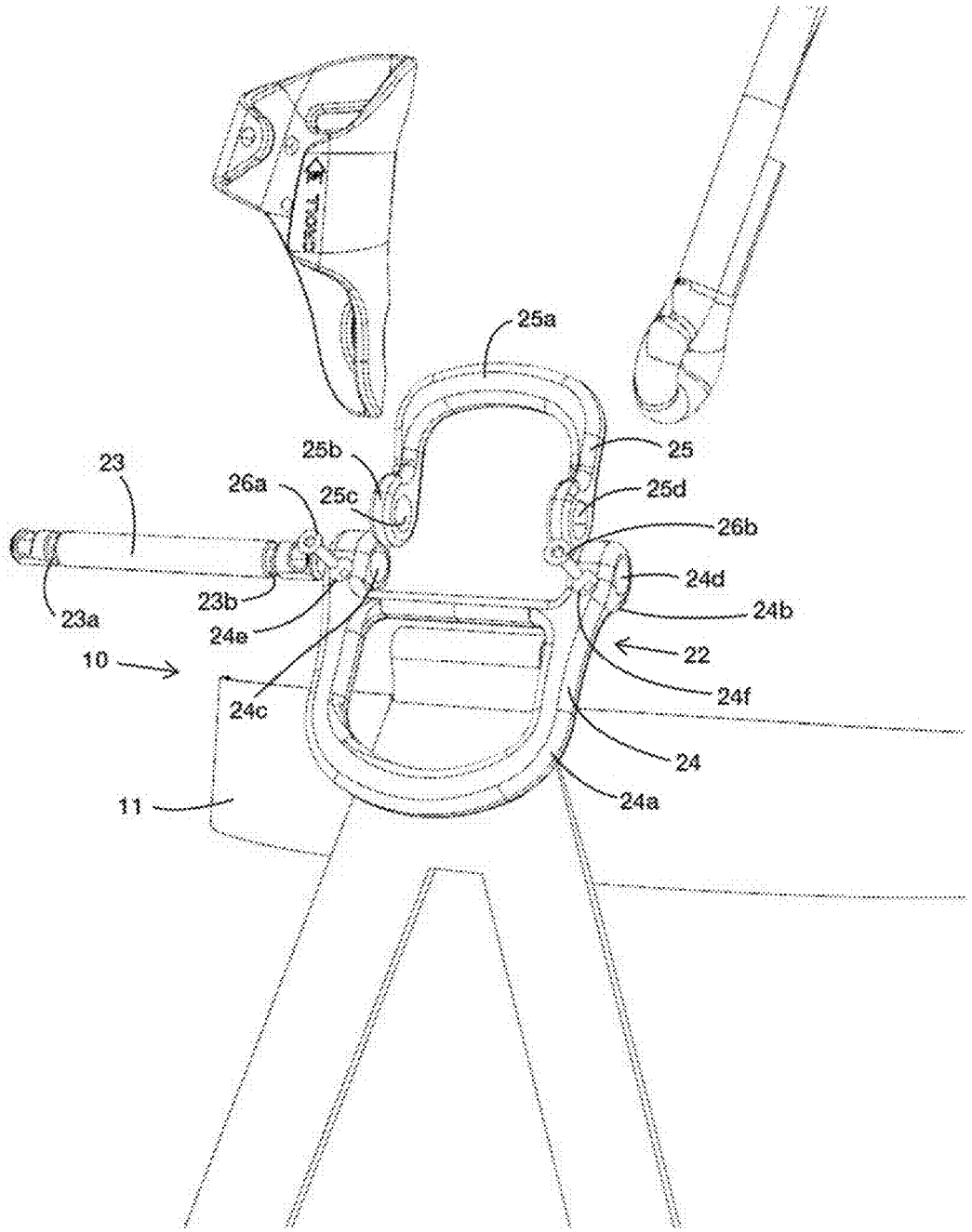
FIG. 10 is an exploded view of the connector according to the embodiment illustrated in FIG. 9, FIG. 11 schematically illustrates another embodiment of a connector.

FIGS. 9 and 10 present an alternative embodiment of a connector 22 fitted on the harness 10.

Here the connector 22 defines a first connecting ring and a second connecting ring distinct from the first connecting ring. The first and second connecting rings each define a closed contour. The two connecting rings can move with respect to one another, preferably in rotation and even more preferentially only in rotation.

The connector 22 comprises a rod 23 of longitudinal axis AA which makes the mechanical connection with the belt 11, preferably via a connecting strap.

The connector 22 comprises a first part 24 defining a closed contour also called connecting ring 24*a*. The first part 24 is fitted movable in rotation with respect to the belt 11 around the axis AA of the rod 23. The connector 22 also comprises a second C-shaped part 25 fitted movable in rotation around a third axis CC (not represented) parallel to the axis AA. The second part 25 is mounted movable in rotation with respect to the first part 24 around the third axis CC.

What is meant by C-shaped is that the second part 25 does not define a closed contour and that it is possible to place an accessory for progression on the rope on the second part 25 without having recourse to a karabiner or a quick link. The second part can quite easily be U-shaped, M-shaped, V-shaped, W-shaped, or be of any shape not being a closed contour. However, once the second part 25 has been fitted in the connector 22, a closed contour is formed by means of the second part 25 and its fixing rod, for example the rod 23 in FIGS. 9 and 10. These two parts also define a connecting ring.

The parts of the connector 22 can advantageously be separated by a user in order to be able to insert at least one accessory for progression on the rope on the second C-shaped part 25.

Furthermore, the connector 22 is advantageously attached to the ventral part of the belt 11 by a connection with a strap. The strap defines a loop and the rod 23 is inserted in this loop to mechanically connect the belt 11 to the connector 22. The strap advantageously passes between the rod 23 and the closed contour of the first part 24, and surrounds the rod 23. The connector 22 is fitted on the harness 10 at the time when the different parts of the connector 22 are assembled to one another.

The connector 22 is arranged on the harness 10 in such a way that the first part 24 is configured to be placed against the belt 11 or the user in the direction of the pair of thigh straps 12, whereas the second part 25 is configured to be placed against the belt 11 or the user in the direction of the pair of shoulder straps 13. The positions of the first and second parts 24 and 25 can however be reversed without this modifying the general operation of the harness 10.

According to one embodiment, the axis CC of rotation of the second part 25 can be different from the axis AA of rotation of the first part 24. This means for example that the connector 22 can comprise an additional rod (not represented) of axis CC, and which can be separated from the first and second parts 24 and 25 in order to place an accessory for progression on the rope on the second part 25. This embodiment is however less advantageous as the connector 22 is more bulky than a single axis which simultaneously connects the first part 24 with the belt 11 and second part 25.

The rod 23 is assembled in the connector 22 outside the connecting ring formed by the first part 24. In advantageous manner, the rod 23 defines a hole with the outer edge of this connecting ring. A connecting strap between the belt 11 and the pair of thigh straps 12 can therefore pass through the hole without passing through the connecting ring formed by the first part 24. The closed contour of the connecting ring protects the strap from possible impacts caused by karabiners or other connection parts placed in the connecting ring. This precaution enables the lifetime of the strap to be increased.

As an alternative, the axis CC parallel to the axis AA can correspond to one side of the connecting ring formed by the first part 24. The second part 25 can be mounted in rotation on the first part 24. The rod 23 is then separated from the axis CC by a part of the connecting strap between the belt 11 and the pair of thigh straps 12. This embodiment is less advantageous than a common axis as the second part 25 can press against the strap thereby making the latter wear prematurely and/or cause a large lateral play along the axis AA.

According to the embodiment illustrated in FIG. 9 and described in the following, the longitudinal axis CC is identical to the longitudinal axis AA, which means that the second part 25 is mounted movable in rotation with respect to the belt 11 around the rod 23.

For the connector 22 to be as functional as possible, it is advantageous to use first and second parts 24 and 25 which have specific three-dimensional shapes.

The first part 24 can be a flat part, i.e. the extreme peripheral area of the part is contained in a plane and/or the internal peripheral area of the connecting ring is contained in a plane. The connectors of the prior art are not advantageous in such an embodiment. The latter are curved towards the outside at the level of their distal part which may be unpleasant for the user as the curved part may come into contact with the abdomen.

It is advantageous for the connecting ring formed by the first part 24 to be flat and for the axis AA to be offset with respect to this plane. The axis AA can advantageously be offset against the belt 11 when the connecting ring is oriented on the side where the thigh straps 12 are located In other words, the connecting ring is contained in a first flat area of the first part 24 so as to define a first plane P1. The rod 23 can advantageously be eccentric with respect to this first plane P1.

The first and second parts 24 and 25 are movable in rotation around the rod 23. It is particularly advantageous to provide for the fixing areas of the first part 24 with the rod 23 to be separated by the two fixing areas of the second part 25 with the rod 23.

As an alternative, it is also possible to provide for the fixing areas of the second part 25 with the rod 23 to be separated by fixing areas of the first part 24 with the rod 23. An alternation between the fixing areas of the first and second parts 24 and 25 is preferably to be avoided as the forces in the first and second parts 24 and 25 are less well distributed when the two parts are folded onto one another.

The embodiment of the connector 22 illustrated in FIGS. 9 and 10 enables folding of the first part 24 on the second part 25 to be limited. In another configuration, it is advantageous to provide additional peripheral pins which increases the surface occupied by the connector 22.

According to the preferred embodiment illustrated in the figures, the first part 24 comprises a first jointed area 24*b* connecting the connecting ring 24*a* with the rod 23. In side view, the first part 24 can be L-shaped and be connected to the rod 23 at the level of one of the ends of the L. The connecting ring 24*a* is therefore a fiat area and corresponds to a branch of the L, whereas the other branch of the L is comprised in the first jointed area 24*b*. The first plane P1 can correspond to any plane passing inside the first part 24 and parallel to the edges of the connecting ring 24*a*.

Thus, when a vertical force is applied in the connecting ring 24*a*, the distal part of the first part 24 is slightly offset from the user's abdomen which prevents any hindrance.

In the same way, it may be advantageous to reproduce this particular shape with the second part 25. The axis AA is advantageously offset against the belt 11 when the C-shaped part is oriented on the side where the thigh straps 12 are located.

The C-shaped distal part of the second part 25 is contained in a second flat area 25*a* of the part, so as to define a second plane P2. The rod 23 can advantageously be eccentric with respect to this second plane P2.

On account of the fact that the second part 25 is movable in rotation around the rod 23, this results in the second part 25 being able to comprise a second jointed area 25*b* connecting the closed contour to the rod 23. Laterally the second part 25 can be L-shaped and be connected to the rod 23 at the level of one of the ends of the L. The second flat area 25*a* therefore corresponds to one branch of the L, whereas the other branch of the L is comprised in the second jointed area 25*b*. The second plane P2 can correspond to any plane passing inside the second part 25 and parallel to the edges of the second flat area 25*a*.

As indicated in the foregoing, to facilitate fitting of the different parts composing the connector 22, one of the parts can be wider than the other in the direction of the axis AA so as to surround the smaller part. For example, the first part 24 can surround the second part 25 at the level of the axis AA.

For this, the first part 24 can comprise first and second attachment means 24*c* and 24*d* placed in the fixing areas of the first part, configured to allow passage of the rod 23. The first and second attachment means 23*c* and 23*d* are advantageously separated by a first distance L1 along the axis AA. The second part 25 can also comprise third and fourth attachment means 25*c* and 25*d* placed in the fixing areas of the second part configured to allow passage of the rod 23. The third and fourth attachment means 25*c* and 25*d* are advantageously separated by the second distance L2 along the axis AA which is smaller than the distance L1. In this way, the third and fourth attachment means 25*c* and 25*d* are advantageously situated between the first and second attachment means 24*c* and 24*d*. This means that the first part 24 surrounds the second part 25.

The attachment means can for example be annular parts or clips, and advantageously be of slightly larger cross-section than the diameter of the rod 23 so as to facilitate rotation of the first and second parts 24 and 25 on the rod 23. What is meant by slightly larger is that the diameter of the annular parts or clips is about 0.1 mm larger than the diameter of the rod 23.

Structurally, it is preferable for the first and second parts 24 and 25 to be fitted without functional clearance in the direction of the axis AA so that the parts cannot translate with respect to one another. The first and second parts 24 and 25 can therefore be only movable in rotation with respect to one another.

To prevent any lateral movement of the first and second parts 24 and 25 along the rod 23, the latter can comprise first and second recesses 23*a* and 23*b* which collaborate with blocking rods 26*a* and 26*b* which are inserted in the connector 22.

The first and second blocking rods 26*a* and 26*b* are advantageously of tubular or cylindrical shape and can for example be screws, rivets, or nails. The width of the first and second recesses 23*a* and 23*b* along the axis AA is slightly larger than the diameter of the first and second blocking rods 26*a* and 26*b* so that the fixing means can be inserted in the recesses 23*a* and 23*b*.

According to the embodiment illustrated in FIG. 10, the first and second blocking rods 26*a* and 26*b* are inserted in first and second holes 24*e* and 24*f*. As an alternative, the first and second holes could be located on the second part 25. A combination of the embodiments is also possible with 2, 3, or 4 blocking rods.

In so far as the first and second parts 24 and 25 are fitted without functional clearance along the axis AA, it is also possible to provide a rod 23 comprising a single recess 23*a*, configured to collaborate with a single blocking rod 26*a* placed in a single hole positioned indifferently on the first part 24 or on the second part 25.

The position of the first and second holes 24*e* and 24*f* can be chosen such that the axes of the first and second blocking rods 26*a* and 26*b* are secant or not with the axis AA. If the axes of the first and second blocking rods 26*a* and 26*b* are secant with the axis AA, their ends are placed in the recesses but not necessarily right up to the stop. If on the other hand the axes of the first and second blocking rods 26*a* and 26*b* are not secant with the axis AA, the latter then tangent the rod 23 at the level of the recesses 23*a* and 23*b* so as to allow rotation of the parts 24 and 25 along the axis AA, but not translation of the latter.

As illustrated in FIG. 10, the first and second holes 24*e* and 24*f* open onto the attachment means 24*c* and 24*d* and come and tangent the rod 23 at the level of the first and second recesses 23*a* and 23b. This has the effect of preventing translation movements of the first and second parts 24 and 25 when they are fitted without functional clearance with respect to one another.

Fitting of the first and second parts 24 and 25 on the rod 23 can be performed in two different manners. The most advantageous consists in superposing the first and second flat areas 24*a* and 25*a* when the first and second parts 24 and 25 are folded onto one another. It should however be noted that the jointed shape of the first and second parts 24 and 25 prevents them from being completely folded onto one another. The edge of the connecting ring 24*a* located in proximity to the rod 23 comes up against the stop formed the edge of the C-shaped area 25*a*.

The value of the offsets between the planes P1 and P2 and the axis AA, and the thicknesses of the first and second parts 24 and 25, are chosen such that the angle formed between the two parts is sufficient to leave mobility for the progression accessories on the rope which will be installed on one or the other of the parts 24 and 25. Progression on the rope is thereby facilitated as the movements of the latter are not hampered by the connecting parts used by the user.

This configuration where the first and second parts are folded onto one another occurs for example when the climber uses a descender attached to the first part 24. Use of the descender has the effect of making the first part 24 swivel towards the pair of shoulder straps 13.

However, to guarantee user comfort, the angle formed between the first and second parts 24 and 25 when they are folded onto one another has to be sufficiently small not to hamper the user. Indeed, if the first and second parts 24 and 25 are too far apart from one another, the second part 25 could exert a pressure on the user and generate discomfort.

On account of the characteristic dimensions of the connector 22 and of those of the accessories for progression on the rope, the first and second parts 24 and 25 can advantageously be separated by an arc length comprised between 0.5 and 3 cm, the arc length being measured with respect to the point farthest from the axis AA.

For example, if the first part 24 is larger than the second part 25, the arc length is measured between the first part and the end of the second part which is opposite the axis AA. In opposite manner, if the first part 24 is smaller than the second part 25, the arc length is measured between the second part and the end of the first part which is opposite the axis AA.

To fit a connector 22 on a harness 10 such as the one which has just been described, it is first of all necessary to attach at least one accessory for progression on the rope on the second C-shaped part 25. This makes it possible to limit the number of karabiners or quick links attached to the connector 22, thereby facilitating use of the latter due to a smaller volume.

The first part 24, the second part 25 and the strap connecting the belt 11 to the thigh straps 12 are then connected by means of the rod 23 so that the strap is positioned between the rod 23 and the connecting ring 24a. This enables the strap to be protected from possible friction due to the progression accessories. The connector 22 is then positioned on the ventral part of the belt 11 so as to enable it to be used for the purposes of progression on the rope.

The rod 23 is first of all inserted in the first attachment means 24*c* of the first part 24, and then in the third attachment means 25*c* of the second part 25.

The rod 23 is inserted in the loop. The rod 23 finally passes through the fourth attachment means 25*d* of the second part 25 and the second attachment means 24*d* of the first part 24. The blocking rods 26*a* and 26b are used in order to prevent any translation of the first and second parts 24 and 25 along the rod 23.

After fitting, it is for example possible to attach a descender on the first part 24 by means of a karabiner or a quick link. This makes it possible to alternate easily between use of the clamp of the rope placed on the second part 25 and use of the descender placed on the first part 24. If a clamp and a descender are positioned in this manner on the connector 22, it is then preferable for the first part 24 to be positioned in the direction of the pair of thigh straps 12, and for the second part 25 to be positioned in the direction of the pair of shoulder straps 13. This configuration is optimal in terms of user comfort, the user not being hampered by the connector 22 during his progression on the rope.

According to the embodiments of FIGS. 9 and 10, the first part 24 defines a closed connecting ring 24*a* on its own. This configuration enables the strap connecting the connector 22 to the pair of thigh straps 12 to be separated from all the parts which are fitted inside the connecting ring 24a.

In an alternative embodiment, not represented, of the connector 22, the first part 24 can be a C-shaped part, like the second part 25. The connecting ring 24*a* is then defined by the assembly of the C-shaped part and of the rod 23 so as to form a closed contour. The first part 24 can be a monoblock part or on the contrary it can be formed by several different parts.

The rod 23 of the connector 22 can be made with grooves and/or hooks at its ends in order to collaborate with the first and second attachment parts 17 and 18 described above. For example purposes, the connector 22 illustrated in FIG. 9 comprises a rod 23 provided with a hook at each end, each hook being designed to collaborate with an attachment part of a chair.

The rod 23 could be made with a groove at a first end and a hook at a second end opposite the first end. It could also be made with a groove at each end.

Figure 11:
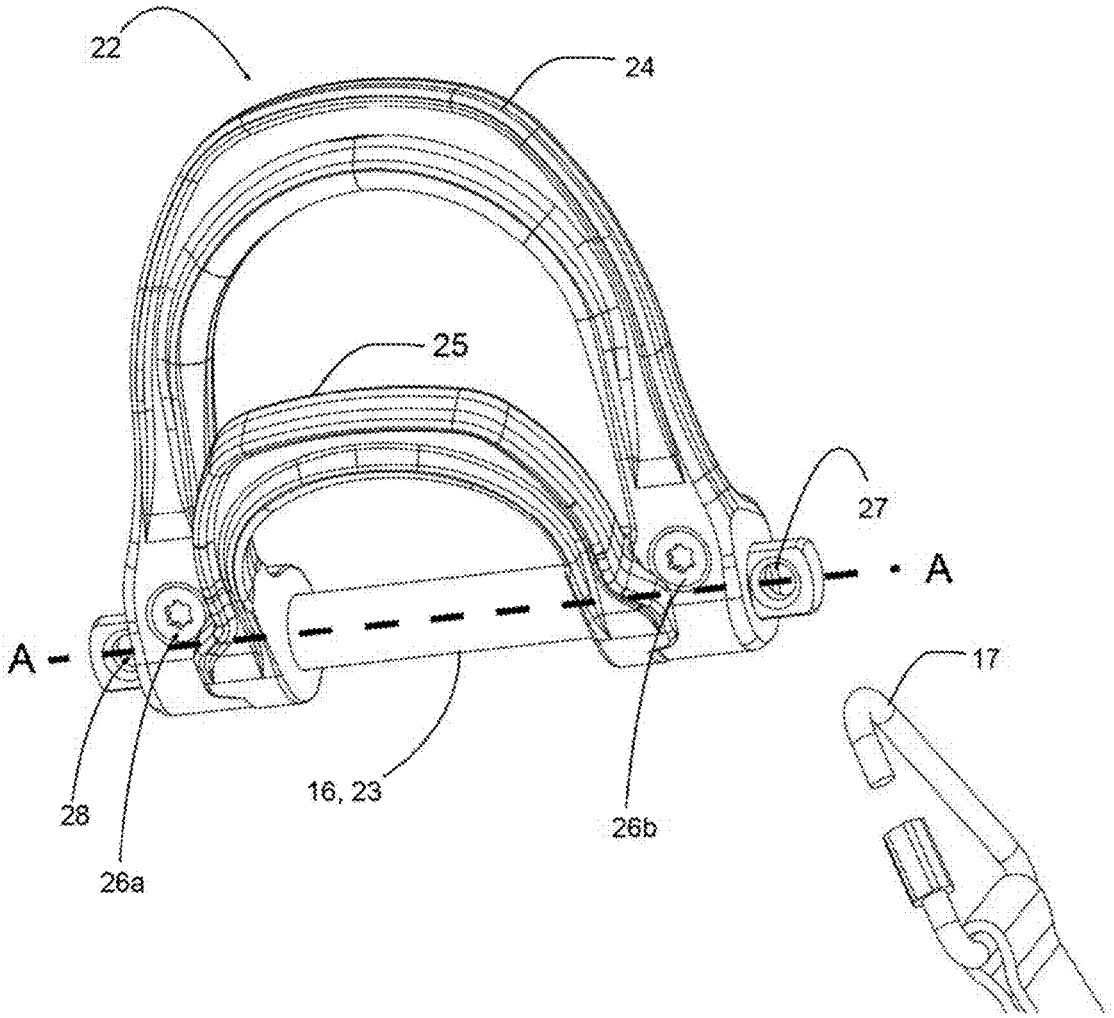

In another embodiment which is illustrated in FIG. 11, the rod 23 has a pass-through aperture 26 which is configured to collaborate with the first attachment part 17. The first pass-through aperture is located outside the connector 22 in order to facilitate rotation of the rod 23 independently from the connector 22. In particularly advantageous manner, the rod 23 has two pass-through apertures 26 and 27 which respectively collaborate with first and second attachment parts 17 and 18. The two pass-through apertures 26 and 27 are advantageously separated by the connector 22 and even more preferentially arranged at the two opposite ends of the rod 23.

In preferential manner, the two pass-through apertures present the same cross-section in a cutting plane perpendicular to the longitudinal axis of the aperture. In a particular embodiment, the apertures present a circular cross-section, but it is also possible to provide apertures with cross-sections that are square, rectangular, ovoid or of any other shape.

It is particularly advantageous to provide for the two longitudinal axes of the apertures to be parallel and advantageously included in the same plane which passes through the axis of rotation of the rod 23.

In this case, it is advantageous to provide for the attachment parts to be karabiners, shackles which define a ring which prevents the chair from coming detached. As an alternative, it is also possible to provide for the attachment parts to be hooks which enable the chair to be attached and detached more easily, The use of a rod 23 provided with one or two pass-through apertures 26 and 27 makes it possible to take advantage of all the features of a device as illustrated in FIGS. 6, 7, 8 and 9.

As for the previous embodiments, it is possible to provide a connector which defines a connecting ring or two distinct connecting rings which can move in rotation with respect to one another. It is advantageous to provide for the pass-through apertures to be located outside the two connecting rings. In the embodiment illustrated in FIG. 11, the two connecting rings are formed in different connectors, here the first and second parts 24 and 25 of the connector 22.

The invention claimed is:

1. A harness comprising a belt, a pair of thigh straps and a ventral suspension point, the ventral suspension point comprising:

a connector positioned on the belt, the connector comprising a connecting ring fitted to be rotatable with respect to the belt around an axis of rotation, the connecting ring being a closed ring defining a first area, and a rod having a longitudinal axis that forms the axis of rotation of the connector, the rod fixing the connector to the belt, the rod comprising a first end and a second end opposite the first end, the first end and the second end being disposed along the axis of rotation of the connector, and a first attachment opening and a second attachment opening designed to cooperate for fixing an external device, the first attachment opening and the second attachment opening being defined in the rod outside the first area so that the axis of rotation of the connector passes through the first attachment opening and the second attachment opening.

2. The harness according to claim 1, further comprising a first attachment part fixed to the connector by means of the first attachment opening and mounted to be rotatable with respect to the rod around an axis that is perpendicular to the axis of rotation of the connector.

3. The harness according to claim 2, further comprising a second attachment part that is mounted on the rod by means of the second attachment opening to be rotatable with respect to the rod.

4. The harness according to claim 1, wherein the connecting ring is mounted to be rotatable with respect to the rod around the axis of rotation.

5. The harness according to claim 1, wherein the first attachment opening of the rod is a first pass-through hole.

6. The harness according to claim 1, wherein the first attachment opening is an opening formed by a first hook formed on the first end of the rod.

7. The harness according to claim 6, further comprising a first attachment part fixed to the connector by means of the first hook and mounted to be rotatable with respect to the rod around an axis perpendicular to the axis of rotation of the connector, wherein:

the first attachment part and the first hook define a first position enabling insertion and extraction of the first attachment part in the first attachment opening formed by the first hook, and a second position configured to disable extraction of the first attachment part, and the first position is distinct from the second position by a rotation of the first attachment part with respect to the first hook around the axis perpendicular to the axis of rotation of the connector.

8. The harness according to claim 7, wherein the first attachment part comprises a ring configured to cooperate with the first hook so as to define the first and second positions.

9. The harness according to claim 1, wherein the rod is mounted to be movable with respect to the connector along the axis of rotation of the rod so as to connect or disconnect the connector and the belt.

10. The harness according to claim 1, wherein the connector further comprises a body defining the connecting ring, and a first insertion hole and a second insertion hole configured to enable insertion of the rod into the body, the first and second ends of the rod extending beyond the body and separated by the body, and the harness further comprises first and second attachment parts fixed to the first and second attachment openings, the first attachment part being located at the first end of the rod and the second attachment part being located at the second end of the rod.

11. The harness according to claim 10, wherein the first and second attachment parts block a movement of the rod in translation along the longitudinal axis of the rod when the first attachment part or the second attachment part contacts the body.

12. The harness according to claim 10, wherein the first attachment part is configured to connect and disconnect from the first attachment opening in the rod without mechanically disconnecting the connector and the belt, and without opening the connecting ring.

13. The harness according to claim 10, wherein the rod comprises at least one annular groove around the longitudinal axis and the body defines a hole facing said annular groove, and a blocking rod is inserted in the hole of the body and in the annular groove so as to block translation of the rod with respect to the body along the longitudinal axis of the rod.

14. The harness according to claim 10, wherein the first end of the rod comprises a first pass-through aperture, and the first attachment part is configured to collaborate with the first pass-through aperture so as to be rotatable about the longitudinal axis.

15. The harness according to claim 1, wherein the connecting ring is a non-openable connecting ring.

16. The harness according to claim 1, wherein the rod is separated from the connecting ring by a pass-through hole, and the belt comprises a strap passing through the pass-through hole so as to connect the belt with the connector.

17. A harness comprising a belt, a pair of thigh straps and a ventral suspension point, the ventral suspension point comprising:

a connector positioned on the belt, the connector comprising a connecting ring fitted to be rotatable with respect to the belt around an axis of rotation, the connecting ring being a closed ring defining a first area, and a rod having a longitudinal axis that forms the axis of rotation of the connector, the rod fixing the connector to the belt, the rod comprising a first end and a second end opposite the first end, the first and second opposite ends being disposed along the axis of rotation of the connector, and a first attachment groove and a second attachment groove designed to cooperate for fixing an external device, the first attachment groove and the second attachment groove being defined in the rod outside the first area so as to form annular grooves around the axis of rotation of the connector.

18. The harness according to claim 17, further comprising a first attachment part fixed to the connector by means of the first attachment groove and mounted to be rotatable with respect to the rod around the axis of rotation of the connector.

19. The harness according to claim 18, wherein the first attachment part comprises an opening configured to cooperate with the first attachment groove so that the first attachment part is mounted to be rotatable with respect to the rod around an axis perpendicular to the axis of rotation of the connector.

20. The harness according to claim 19, further comprising a second attachment part defining an opening configured to cooperate with the second attachment groove, the first and second attachment parts being independently rotatable around the axis of rotation of the connector.

* * * * *